US006911883B1

(12) United States Patent
Bach et al.

(10) Patent No.: US 6,911,883 B1
(45) Date of Patent: Jun. 28, 2005

(54) ELECTRICAL SWITCHGEAR COMPRISING SEVERAL HOUSING PARTS

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/148,013

(22) PCT Filed: Nov. 21, 2000

(86) PCT No.: PCT/DE00/04201

§ 371 (c)(1),
(2), (4) Date: May 24, 2002

(87) PCT Pub. No.: WO01/39230

PCT Pub. Date: May 31, 2001

(30) Foreign Application Priority Data

Nov. 26, 1999 (DE) ..... 199 58 945

(51) Int. Cl.[7] ..... H01H 67/02
(52) U.S. Cl. ..... 335/132; 335/172
(58) Field of Search ..... 335/132, 6–10, 335/165–176, 202; 200/293–308

(56) References Cited

U.S. PATENT DOCUMENTS

| | | | | | |
|---|---|---|---|---|---|
| 3,451,018 | A | * | 6/1969 | DiMarco | 335/131 |
| 4,133,990 | A | * | 1/1979 | Wanner et al. | 200/6 B |
| 4,527,027 | A | | 7/1985 | Link et al. | |
| 4,568,805 | A | * | 2/1986 | Wycklendt | 218/38 |
| 4,644,308 | A | | 2/1987 | Guery et al. | |
| 4,764,650 | A | | 8/1988 | Bur et al. | |
| 4,899,253 | A | | 2/1990 | Buxton | |

FOREIGN PATENT DOCUMENTS

| | | | | |
|---|---|---|---|---|
| DE | 12 56 775 B | | 12/1967 | |
| EP | 80 27 369 U | | 7/1982 | |
| EP | 0 289 778 A | | 11/1988 | |
| EP | 0 309 924 A | | 4/1989 | |
| FR | 2569899 | * | 3/1986 | 335/132 |

* cited by examiner

*Primary Examiner*—Lincoln Donovan
(74) *Attorney, Agent, or Firm*—Harness, Dickey & Pierce, P.L.C.

(57) ABSTRACT

A switching chamber enclosure includes a number of enclosure parts with specific functional subdivision, in which switching elements are arranged. The enclosure of the switching device is formed at least by one lower shell and one upper shell, which are separated from one another by a horizontal separating joint. In addition, one or more intermediate shells may provided, which are likewise separated from the lower shell, from the upper shell and from one another by horizontal separating joints.

21 Claims, 3 Drawing Sheets

ELECTRICAL SWITCHGEAR COMPRISING SEVERAL HOUSING PARTS

This application is the national phase under 35 U.S.C. § 371 of PCT International Application No. PCT/DE00/04201 which has an International filing date of Nov. 20, 2000, which designated the United States of America, the entire contents of which are hereby incorporated by reference.

FIELD OF THE INVENTION

The invention generally relates to the field of electrical switching devices, and more preferably relates to ones which have at least one switching contact system which can be operated via an actuating shaft and even more preferably relates to ones whose contact surfaces run essentially parallel to a predetermined plane. It is preferably applicable to the design configuration of a switching chamber enclosure which holds the switching contact system and further switch parts, and which includes at least two enclosure parts.

BACKGROUND OF THE INVENTION

In one known electrical switching device in the form of a low-voltage circuit breaker, the switching chamber enclosure includes a front and a rearward enclosure part. Each have a circumferentially closed surface and absorb mechanical forces that occur during operation of the moveable switching contact. These forces act essentially at right angles to the contact surfaces of the switching contact system. In the normal way for low-voltage circuit breakers, the two enclosure parts rest against one another along a separating joint. The joint runs parallel to the axis of the switching shaft. When the switching device is in the in-use position, it runs vertically between the enclosure front wall and the enclosure rear wall.

Since one contact is associated with the front enclosure part and the other contact is associated with the rearward enclosure part, this arrangement requires that the enclosure parts be aligned correctly with one another, such that they match. This arrangement of the contacts also means that the forces which are associated with the switching processes and which run at right angles to the contact surfaces of the switching contacts act on the enclosure parts at right angles to the separating joint. Generally, this means that the enclosure parts must be held together using tie rods (U.S. Pat. No. 4,764,650). Furthermore, a configuration of the switching chamber enclosure such as this makes it necessary to remove the rear wall, in order to gain access to the appropriate assemblies, for the purpose of maintenance or repair of the switching contact systems. Once the appropriate work has been carried out, the front wall and the rear wall must be joined together once again.

With a conventional construction, an enclosure part which is stressed in such a way is subject to mutual alignment via the tie rods via a constriction in the through-holes. When tie rods such as these are used, this results in considerable difficulties in the production of the enclosure parts and of the stamping tools which are required for their production.

Firstly, the manufacturing processes are subject to tight tolerances. Secondly, it is possible for problems to occur during assembly as a result of screws becoming jammed, since the through-holes are formed by relatively long and thus unstable pins in the stamping tool. These pins can be elastically deformed by the stamping force and by the displacement of the substance being molded, as a result of which the through-holes for the tie rods may be misaligned.

In another known low-voltage circuit breaker, an additional element is used to reinforce the connection between the enclosure parts. This element, which is in the form of a dovetail, is arranged between the enclosure parts and extends along the side walls of the enclosure parts within a channel, which is formed by the two enclosure parts, in order to hold the element. This element is used to increase the strength of the connection between the enclosure parts with regard to force transmission, but contributes to mutual alignment of the enclosure parts at most in one plane, namely the horizontal. It also uses a relatively large amount of material and results in additional assembly effort (U.S. Pat. No. 4,899,253).

SUMMARY OF THE INVENTION

An embodiment of the invention is based on an object of reducing the design complexity for coping with the mechanical forces which occur during switching processes, and hence of reducing the assembly effort.

According to an embodiment of the invention, this object is achieved by the separating joint between those housing parts, which are in each case to be joined together, running at right angles to the predetermined plane. This measure improves, for example, the enclosure strength in the direction in which the forces act, such that there is no need to use tie rods to hold the enclosure parts together.

Interlocking alignment arrangements may be provided on the enclosure parts to be joined together, for mutual positive alignment (centering) of the enclosure parts.

The enclosure parts may have teeth on the separating joints.

The interlocking alignment arrangements are expediently arranged on the outer walls of the enclosure parts, or at other suitable points, for example on phase partition walls. This is necessary in particular in large switching devices, such as circuit breakers with single-pole opening, which have a coupling bolt for each pole, in order to secure the coupling bolts axially. The interlocking alignment arrangements may advantageously be in the form of integrally formed lugs on one of the two enclosure parts to be joined together, or in the form of recesses for holding the lugs in the other of the enclosure parts to be joined together. Owing to the integrally formed lugs on one enclosure part and the cutouts in the other enclosure part, through-windows can still be provided after the lugs start to engage in the cutouts. That is, they can be provided when the enclosure shells are already aligned with one another, but before they have been joined together completely.

The positions and the sizes of the interlocking alignment arrangements can be advantageously chosen such that further switch parts. In particular connecting parts, can still be installed before the enclosure parts are finally joined together, in a position in which the switch parts which are already installed on these enclosure parts are also already aligned with one another.

In the case of low-voltage circuit breakers, for example, it is expedient for at least one integrally formed alignment arrangement to be positioned and to be of such a size that, in the state described above, shafts or other connecting parts, for example one or more coupling bolts between the contact and the drive, can be inserted which are fixed at the side by the lugs of the interlocking alignment arrangements. This is preferably done once the enclosure parts have been joined together completely. This ensures that the corresponding part, for example a coupling bolt, is secured axially without any further securing elements since, as mentioned above, alignment arrangements may also be provided in the phase partition walls, if this is necessary.

An arcing chamber, possibly a switching gas damper and an arcing chamber cover are advantageously integrated in one enclosure part. In consequence, no special parts are required for this purpose. The switching gas is ejected through the enclosure part at the end.

In order to make it possible for the cables between sensors and an overcurrent release not to run across an enclosure separation, these items may be provided within one enclosure shell, with a mounting plate for the auxiliary releases being integrated in one enclosure shell, for this purpose. This makes it possible to avoid damage to the connecting cables as can occur in known switching chamber enclosures when, for example, the rear wall is removed for maintenance or repair purposes.

Bearing shells for the actuating shaft are advantageously integrated in the enclosure walls of the enclosure parts. This makes it possible to save additional components for the bearings for the switching shaft.

Outlet openings, through which connecting rails of the switching device are passed, are advantageously provided in the separating joints. This arrangement results in an additional alignment effect on the enclosure parts, by means of the side walls of the outlet openings with the inserted connecting rails, when the enclosure shells are being joined together.

BRIEF DESCRIPTION OF THE DRAWINGS

To assist understanding, the invention will be explained in more detail in the following text using a preferred example, which does not restrict the scope of protection of the invention, and with reference to the associated drawings, wherein.

DETAILED DESCRIPTION OF THE PREFERRED EMBODIMENTS

Figure 1:
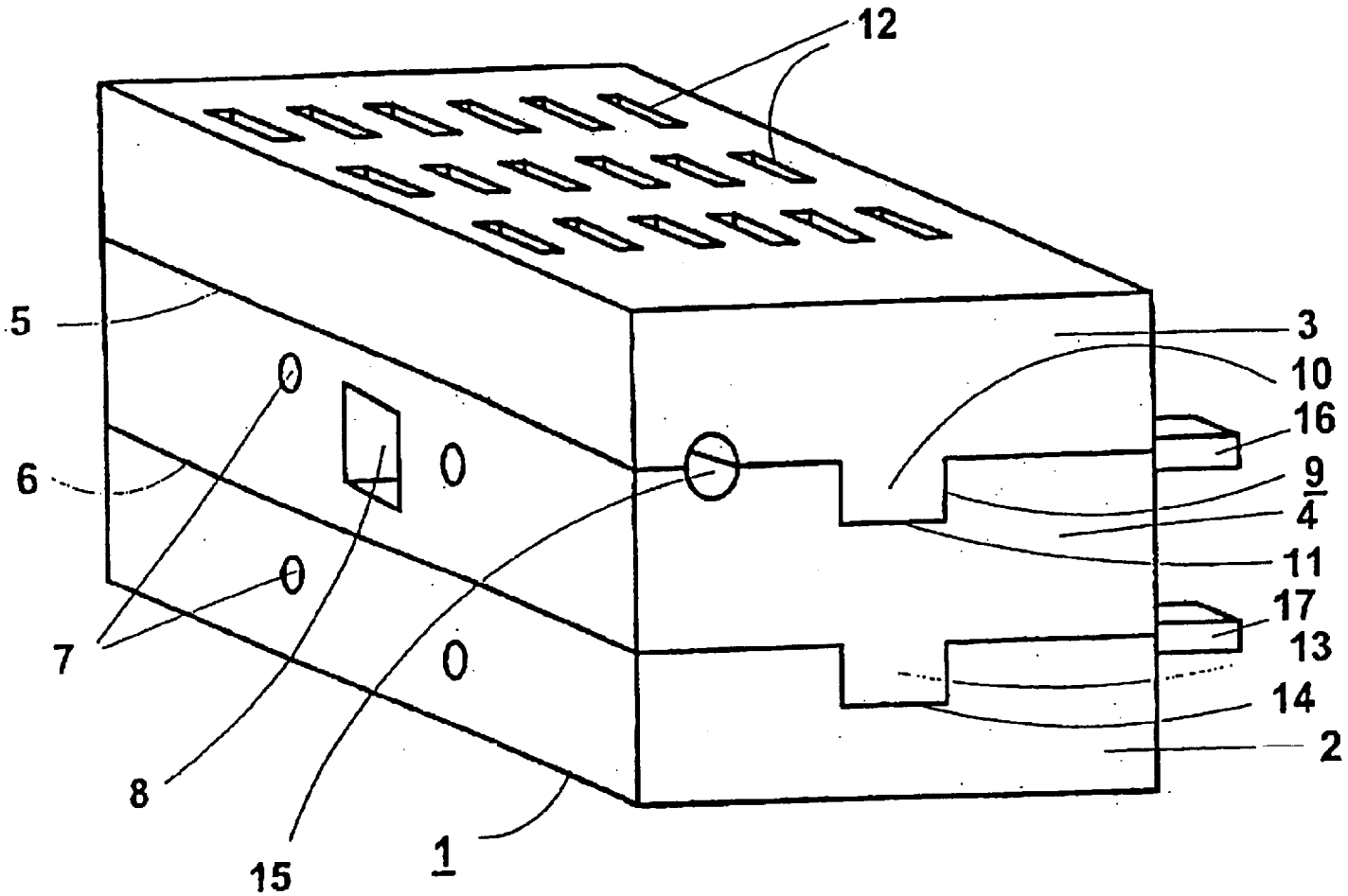
FIG. 1 shows, schematically, a perspective view of the front face of a switching chamber enclosure according to an embodiment of the invention for holding a switching contact system of an electrical switching device, for example a low-voltage circuit breaker, seen from the front right-hand side.

According to FIG. 1, the switching chamber enclosure includes a number of enclosure parts, namely a lower shell 2, an upper shell 3 and an intermediate shell 4, which are separated from one another by means of horizontal separating joints 5; 6.

Attachment holes 7 are provided on the front face of the switching chamber enclosure 1 for a switch drive (which is not illustrated), and a through-opening 8 is provided for a switching linkage, which is likewise not illustrated.

For correct matched alignment (centering) of the individual enclosure parts, the lower shell 2, the upper shell 3 and the intermediate shell 4 are provided with alignment arrangements 9 on the separating joints 5; 6, such that, when the enclosure parts are being joined together, the switch parts to be assembled are also aligned with one another.

The interlocking alignment arrangements 9 are in the form of integrally formed lugs 10 on the two sides (one side cannot be seen) in the separating joint 5 on the upper shell 3, and are in the form of recesses 11 for holding the said lugs 10, in the intermediate shell 4. Integrally formed lugs 13 (one side cannot be seen) on the intermediate shell 4 are provided in the separating joint 6, and recesses 14 for holding the integrally formed lugs 13 are provided on the lower shell 2. Blowing openings 12 of an arcing chamber, which is arranged such that it is integrated on the upper shell 3, emerge from the upper shell 3 at the top.

Bearing shells 15 for an actuating shaft are integrated in the enclosure walls, in the separating joint 5 between the upper shell 3 and the intermediate shell 4. This makes it possible to save additional components for the bearings for the actuating shaft.

Figure 2:
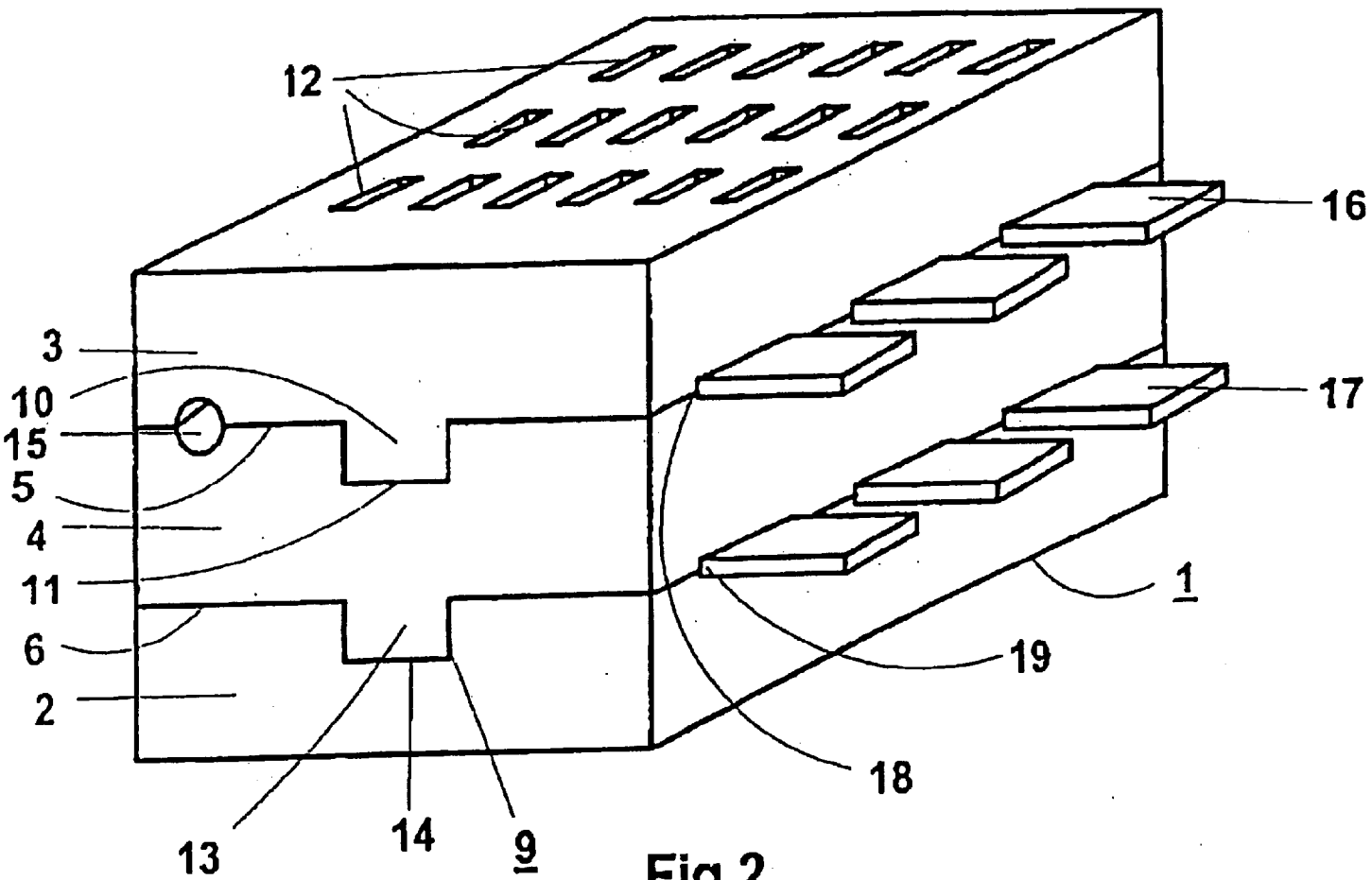
FIG. 2 shows, schematically, a perspective view of the rear face of the switching chamber enclosure shown in FIG. 1, seen from the rear left-hand side.

As shown in FIG. 2, in which the already explained enclosure parts are provided with the same reference symbols as in FIG. 1, outlet openings 18, 19, which are arranged in the separating joints, together with the upper and lower connecting rails 16; 17 which emerge there exert an additional alignment effect on the enclosure shells 2; 3; 4.

Figure 3:
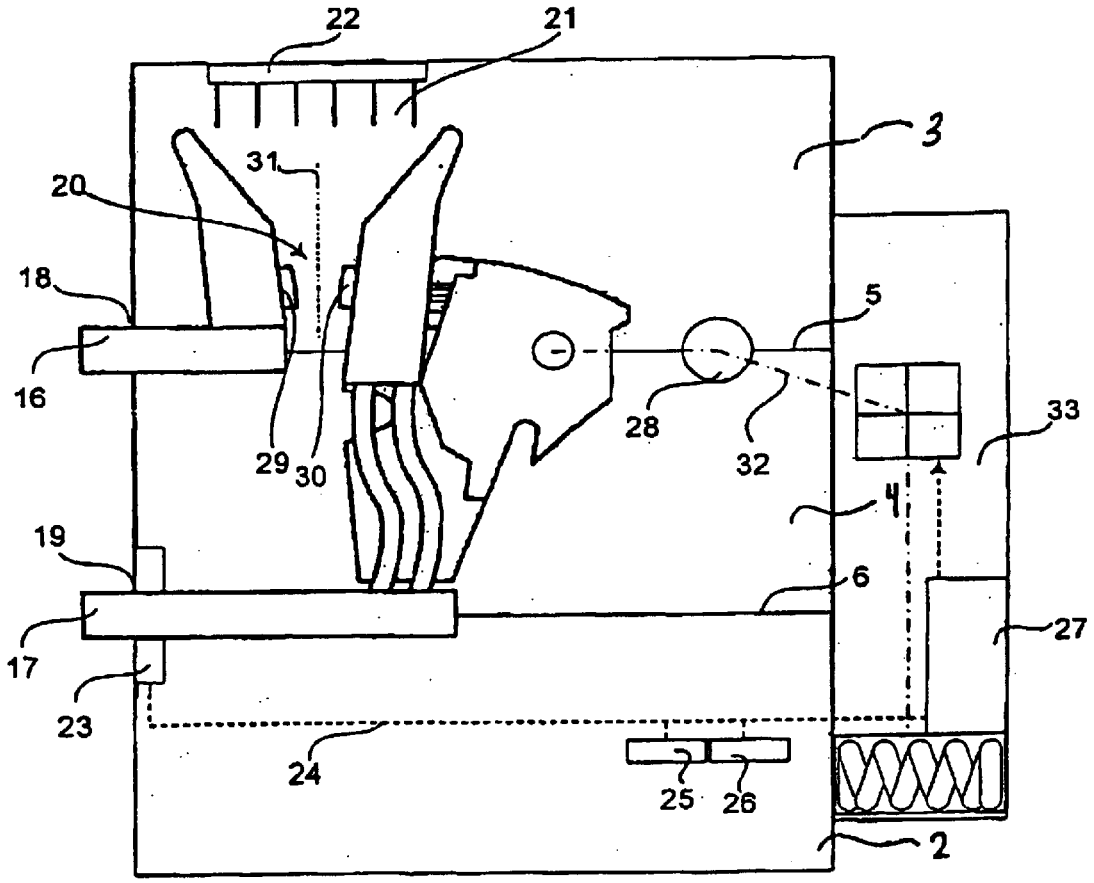
FIG. 3 schematically shows a sectional view of the switching chamber enclosure depicted in FIGS. 1 and 2.

According to FIG. 3, the switching chamber housing 1 comprises a switching-contact system 20 and additional switch parts, such as the light-arc quenching chamber 21, the switching gas damper 22, sensors 23, the cable guide 24, the auxiliary triggers 25, 26, the excess current trigger 27 and the switching shaft 28.

The switching shaft 28 functions in the known manner for actuating the switching contact system 20, for which the contact surfaces 29, 30 essentially run parallel to a predetermined plane 31. The three housing parts 2, 3, 4 of switching chamber housing 1, which absorb the mechanical forces that are generated in approximately perpendicular direction to the contact surfaces 29, 30 during the actuation of the switching contact system 20, fit against each other along the separating joints 5, 6. The separating joints 5, 6 in this case extend parallel to the switching shaft 28 axis and perpendicular to the predetermined plane 31. FIG. 3 furthermore shows the switching rod assembly 32, which extends through the openings 8 for the embodiment shown in FIG. 1, as well as the switching drive 33 that is attached to the front of the switching chamber housing via the fastening holes 7, also shown in FIG. 1.

The solution according to an embodiment of the invention has at least one of the following advantages:

Improvement in the housing strength in the direction in which force is applied by the action of force from contact force springs and short-circuit loads. The tie rods for holding the front wall and rear wall together are no longer used to absorb forces, as was previously normal. In this embodiment, the forces occur in one and the same part and are absorbed by this part, without any joint whatsoever needing to be bridged by elements such as tie rods to absorb forces. This means that those forces which were previously exerted on the enclosure parts, such as the front and rear walls of the low-voltage circuit breaker, and which attempted to force them apart, are now intrinsically absorbed by the enclosure shell.

The positioning of the actuating shaft in the separating joint between two enclosure shells arranged one above the other, and the integration of the bearing shells in them, means that there is no longer any need for separate bearing elements.

The assembly time during manufacture is minimized. During assembly of the switch, the lower connecting rails together with the moveable contacts can be inserted into the lower shell from underneath. The accessibility of the coupling point from above allows simple coupling to the exposed actuating shaft. This means simple, uncomplicated access to parts which may be subject to wear. The upper connecting rail is installed in the upper shell.

The tolerances for auxiliary contacts for control and signaling purposes are minimized. Relevant, associated and interacting parts are all arranged in one enclosure part; in consequence, there are no tolerances resulting from the assembly of the enclosure parts.

The fact that the arcing chambers are inserted into the upper shell means that the switching contacts can easily be maintained simply by lifting off the upper shell, since they arc easily visible and are in an open position once the upper shell has been removed.

The integrated arcing chamber cover reduces the complexity for connection. There are no gaps to be secured by complex labyrinths. The blowing cover is a component of the upper shell, and there are no joints that need to be sealed.

It is even possible to provide channels, for the cables from the sensors to the overcurrent releases and display instruments, while the enclosure parts are being manufactured. The cables cannot be damaged. No measures, such as a rear wall attached by hinges, are required in order to avoid damage (tearing off) to the sensitive power cables between the current transformers and the overcurrent releases, which are located at the front.

The switching chamber enclosure can be disassembled, without any problems, for repair and maintenance work.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching chamber enclosure for holding at least one switching contact system and switch parts for an electrical switching device, wherein an actuating shaft is provided for operation of the at least one switching contact system, and wherein contact surfaces of the at least one switching contact system run essentially parallel to a predetermined plane, the switching chamber enclosure comprising:

at least two enclosure parts resting against one another along a separating joint that, extends parallel to the axis of the actuating shaft, so that the enclosure parts absorb mechanical forces occurring during operation of the at least one switching contact system, extends approximately at right angles to the contact surfaces, and extends at right angles to the predetermined plane.

2. The switching chamber enclosure as claimed in claim 1, wherein interlocking alignment arrangements are provided on the enclosure parts for mutual positive alignment of the enclosure parts.

3. The switching chamber enclosure as claimed in claim 2, wherein the interlocking alignment arrangements are in the form of integrally formed lugs on at least one of the enclosure parts, and are in the form of recesses, for holding the lugs, in at least one other of the enclosure parts.

4. The switching chamber enclosure as claimed in claim 1, wherein an arcing chamber, a switching gas damper and an arcing chamber cover are integrated in at least one enclosure part.

5. The switching chamber enclosure as claimed in claim 1, wherein bearing shells for the actuating shaft are integrated in the enclosure walls of at least one of the enclosure parts.

6. The switching chamber enclosure as claimed in claim 1, wherein outlet openings are provided in the separating joint for connecting rails to be passed out.

7. The switching chamber enclosure as claimed in claim 1, wherein at least two enclosure parts are provided at ends of the switching chamber enclosure and at least one intermediate enclosure part is provided.

8. The switching chamber enclosure as claimed in claim 2, wherein an arcing chamber, a switching gas damper and an arcing chamber cover are integrated in at least one enclosure part.

9. The switching chamber enclosure as claimed in claim 3, wherein an arcing chamber, a switching gas damper and an arcing chamber cover are integrated in at least one enclosure part.

10. The switching chamber enclosure as claimed in claim 2, wherein bearing shells for the switching shaft are integrated in the enclosure walls of at least one of the enclosure parts.

11. The switching chamber enclosure as claimed in claim 3, wherein bearing shells for the actuating shaft are integrated in the enclosure walls of at least one of the enclosure parts.

12. The switching chamber enclosure as claimed in claim 4, wherein bearing shells for the actuating shaft are integrated in the enclosure walls of at least one of the enclosure parts.

13. The switching chamber enclosure as claimed in claim 2, wherein outlet openings are provided in the separating joint for connecting rails to be passed out.

14. The switching chamber enclosure as claimed in claim 3, wherein outlet openings are provided in the separating joint for connecting rails to be passed out.

15. The switching chamber enclosure as claimed in claim 4, wherein outlet openings are provided in the separating joint for connecting rails to be passed out.

16. The switching chamber enclosure as claimed in claim 5, wherein outlet openings are provided in the separating joints for connecting rails to be passed out.

17. The switching chamber enclosure as claimed in claim 2, wherein at least two enclosure parts are provided at ends of the switching chamber enclosure and at least one intermediate enclosure part is provided.

18. The switching chamber enclosure as claimed in claim 3, wherein at least two enclosure parts are provided at ends of the switching chamber enclosure and at least one intermediate enclosure part is provided.

19. The switching chamber enclosure as claimed in claim 4, wherein at least two enclosure parts are provided at ends of the switching chamber enclosure and at least one intermediate enclosure part is provided.

20. The switching chamber enclosure as claimed in claim 5, wherein at least two enclosure parts are provided at ends of the switching chamber enclosure and at least one intermediate enclose part is provided.

21. The switching chamber enclosure as claimed in claim 6, wherein at least two enclose parts are provided at ends of the switching chamber enclosure and at least one intermediate enclosure part is provided.

* * * * *